US008939636B2

(12) United States Patent
Choi et al.

(10) Patent No.: US 8,939,636 B2
(45) Date of Patent: Jan. 27, 2015

(54) LIGHT SOURCE ASSEMBLY FORMED OF A PLURALITY OF LIGHT SOURCE MODULES DETACHABLY CONNECTED TOGETHER

(71) Applicant: Samsung Electronics Co., Ltd., Suwon-si, Gyeonggi-do (KR)

(72) Inventors: Ki Won Choi, Gyeonggi-do (KR); Yeon Woo Lee, Seoul (KR)

(73) Assignee: Samsung Electronics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 13/941,203

(22) Filed: Jul. 12, 2013

(65) Prior Publication Data

US 2014/0140062 A1 May 22, 2014

(30) Foreign Application Priority Data

Nov. 21, 2012 (KR) ..... 10-2012-0132226

(51) Int. Cl.
*F21V 21/005* (2006.01)
*F21S 2/00* (2006.01)
*F21Y 101/02* (2006.01)

(52) U.S. Cl.
CPC ..... *F21V 21/005* (2013.01); *F21S 2/005* (2013.01); *F21Y 2101/02* (2013.01)
USPC ..... 362/652; 362/658; 362/647

(58) Field of Classification Search
USPC ..... 362/657, 658, 659, 647, 652
See application file for complete search history.

(56) References Cited

U.S. PATENT DOCUMENTS

| | | | | |
|---|---|---|---|---|
| 4,096,379 | A * | 6/1978 | Taylor | 362/235 |
| 4,223,377 | A * | 9/1980 | Williams | 362/145 |
| 4,532,579 | A * | 7/1985 | Merryman | 362/239 |
| 7,553,162 | B2 * | 6/2009 | Isoda et al. | 439/56 |
| 2006/0256584 | A1 * | 11/2006 | Paoluccio | 362/652 |
| 2007/0047243 | A1 * | 3/2007 | Hacker et al. | 362/382 |
| 2009/0009997 | A1 * | 1/2009 | Sanfilippo et al. | 362/244 |
| 2009/0296416 | A1 | 12/2009 | Luo et al. | |
| 2009/0296417 | A1 | 12/2009 | Luo et al. | |
| 2010/0053956 | A1 * | 3/2010 | Park et al. | 362/235 |
| 2010/0073931 | A1 * | 3/2010 | Watanabe | 362/249.02 |
| 2010/0118532 | A1 * | 5/2010 | Liang et al. | 362/235 |

FOREIGN PATENT DOCUMENTS

| | | |
|---|---|---|
| KR | 10-1054721 | 8/2011 |
| KR | 10-1092177 B1 | 12/2011 |
| KR | 10-1116767 B1 | 2/2012 |

* cited by examiner

*Primary Examiner* — Laura Tso
(74) *Attorney, Agent, or Firm* — McDermott Will & Emery LLP

(57) ABSTRACT

A light source assembly includes a plurality of light source modules detachably connected to one another. Each light source module includes a frame part, an electrical connection part, and at least one light emitting device. The frame part includes a female coupling disposed in one side surface thereof and a male coupling disposed on another side surface thereof and configured to be engaged with a female coupling of another light source module of the plurality. The electrical connection part is disposed on an upper surface of the frame part and extends onto the one side surface having the female coupling disposed therein and onto the other side surface having the female coupling disposed thereon. The at least one light emitting device is mounted on the electrical connection part and disposed on the upper surface of the frame part.

19 Claims, 11 Drawing Sheets

LIGHT SOURCE ASSEMBLY FORMED OF A PLURALITY OF LIGHT SOURCE MODULES DETACHABLY CONNECTED TOGETHER

CROSS-REFERENCE TO RELATED APPLICATIONS

This application claims the priority of Korean Patent Application No. 10-2012-0132226 filed on Nov. 21, 2012 in the Korean Intellectual Property Office, the disclosure of which is incorporated herein by reference.

TECHNICAL FIELD

The present inventive concept relates to a light source assembly including a plurality of light source modules detachably connected together.

BACKGROUND

A module having a plurality of light emitting diodes (LEDs) arranged according to a structure design can be used as a light source used in a vehicle lamp. In such a module, different arrangements of LEDs are generally selected depending on various designs of lamps designed for use in different vehicle models.

In general, a module used in vehicle lamps may have a structure in which a back cover, a heat sink, and a substrate are stacked on and fixed to one another. The back cover, heat sink, and substrate are assembled by stacking the heat sink dissipating heat and the substrate supplying electricity to a plurality of LEDs on the back cover, and by compressing these elements. The back cover can be a plastic injection molded product. The back cover and the heat sink on which the LEDs are supported may have various shapes and sizes such that the plurality of LEDs are disposed in predetermined positions in accordance with lamp designs.

To this end, it is necessary to constantly design and manufacture new molds in order to fabricate a back cover and a heat sink to meet a corresponding vehicle model's lamp design. Accordingly, molding costs may be high, large amounts of resources such as manpower, materials and the like may be consumed, and a mold obtained thereby needs to be stored and maintained until the corresponding vehicle model is discontinued.

In addition, in the case in which the exterior of an LED or an LED module is damaged and becomes defective during a module manufacturing process or a lamp assembly process, since it is necessary to change the overall module, high replacement costs and large amounts of raw material loss may be incurred.

Thus, in order to overcome the difficulties and the defects, there has been demand for standardizing an LED support structure, for example, a heat sink, to be commonly used in vehicles, regardless of vehicle model.

SUMMARY

An aspect of the present inventive concept provides alight source assembly capable of being commonly used regardless of a vehicle model, having a standardized heat sink structure, and being easily assembled.

According to an aspect of the present inventive concept, a light source assembly includes a plurality of light source modules detachably connected to one another. Each light source module includes: a frame part including a female coupling disposed in one side surface thereof and a male coupling disposed on another side surface thereof and configured to be engaged with a female coupling of another light source module of the plurality; an electrical connection part disposed on an upper surface of the frame part and extending onto the one side surface having the female coupling disposed thereon and onto the other side surface having the male coupling disposed thereon; and at least one light emitting device mounted on the electrical connection part and disposed on the upper surface of the frame part.

The plurality of light source modules connected to one another may form a step structure in which upper surfaces of each of the plurality of light source modules are disposed on different levels.

The male coupling may include a support portion protruding from the other side surface of the frame part and a fastening portion extending outwardly and orthogonally with respect to the support portion on an edge of the support portion, and wherein the female coupling may have a groove portion having a shape complementary to a shape of the support portion and the fastening portion.

The groove portion may be open to the upper surface of the frame part and may be disposed in a position spaced away from a lower surface of the frame part by a predetermined distance.

The electrical connection part may be provided with an arrangement hole, and the frame part may include a projection on the upper surface thereof, the projection configured to be inserted into the arrangement hole.

The electrical connection part may include electrode pads disposed on the female coupling and the male coupling, and the female coupling of one light source module may be engaged with and connected to the male coupling of another light source module among the plurality of light source modules, such that the electrode pad disposed on the female coupling of the one light source module and the electrode pad disposed on the male coupling of the other light source module are in contact with and electrically connected to each other.

The electrical connection part may further include a substrate covering at least portions of the upper surface, the one side surface, and the other side surface of the frame part and a circuit pattern provided on the substrate and connected to the light emitting device and the electrode pads.

The light source assembly may further include a heat radiation plate disposed on the upper surface of the frame part and interposed between the frame part and the electrical connection part.

The light source assembly may further include a connector connected to the electrical connection part.

According to another aspect of the present inventive concept, there is provided a light source assembly comprising a plurality of light source modules detachably connected to one another. Each light source module includes: a frame part including a receiving groove formed in one side surface thereof, and a protruding unit formed on another side surface thereof and configured to be inserted into a receiving groove of another light source module of the plurality; an electrical connection part disposed on an upper surface of the frame part and extending onto the one side surface having the receiving groove disposed thereon and onto the other side surface having the protruding unit disposed thereon; at least one light emitting device mounted on the electrical connection part and disposed on the upper surface of the frame part; and a fixing element provided in the receiving groove and configured to selectively be coupled to a protruding unit of another light source module of the plurality that is inserted into the receiving groove.

The plurality of light source modules connected to one another may form a step structure in which upper surfaces of each of the plurality of light source modules are disposed on different levels.

The protruding unit and the receiving groove may be disposed at different distances from the upper surface of the frame part, and the plurality of light source modules connected to one another may form a step structure in which each step has a height corresponding to a difference between the distances of the protruding unit and the receiving groove from the upper surface of the frame part.

The fixing element may include an elastic piece provided on each of a pair of side surfaces of the frame part that are perpendicular with regard to the one side surface, wherein each elastic piece is disposed in the receiving groove and has a projecting portion that projects from the elastic piece into the receiving groove.

The protruding unit may be provided with a coupling hole configured to have the projecting portion of another light source module inserted therein and fixed thereto when the protruding unit is inserted into the receiving groove of the other light source module.

The electrical connection part may include electrode pads disposed on the one side surface having the receiving groove formed therein and on the other side surface having the protruding unit formed thereon, and when the protruding unit of one light source module may be inserted into and connected to the receiving groove of another light source module among the plurality of light source modules, the electrode pad disposed on the one side surface of the other light source module and the electrode pad disposed on the other side surface of the one light source module are in contact with and electrically connected to each other.

According to another aspect of the present inventive concept, there is provided a light source assembly comprising a plurality of light source modules detachably connected to one another. Each light source module includes: a frame part including a female coupling disposed in one side surface thereof and a male coupling disposed on another side surface thereof and configured to be engaged with a female coupling of another light source module of the plurality; and at least one light emitting device disposed on an upper surface of the frame part. At least one light source module of the plurality of light source modules has the female coupling disposed in one side surface thereof that is substantially parallel to the other side surface having the male coupling disposed thereon, and at least one other light source module of the plurality of light source modules has the female coupling disposed in one side surface thereof that is substantially orthogonal to the other side surface having the male coupling disposed thereon.

An electrical connection part can be provided for each light source module, the electrical connection part electrically connecting the at least one light emitting device with an electrode pad disposed on the one side surface having the female coupling disposed thereon and with an electrode pad disposed on the other side surface having the male coupling disposed thereon.

A substrate can cover at least portions of the upper surface, the one side surface, and the other side surface of the frame part of each light source module, and can have the electrical connection part formed thereon.

A heat radiation plate can be disposed on the upper surface of the frame part of each light source module, so as to be interposed between the frame part and the substrate.

BRIEF DESCRIPTION OF THE DRAWINGS

The above and other aspects, features and other advantages of the present inventive concept will be more clearly understood from the following detailed description taken in conjunction with the accompanying drawings, in which.

DETAILED DESCRIPTION OF THE EMBODIMENTS

Figure 1:
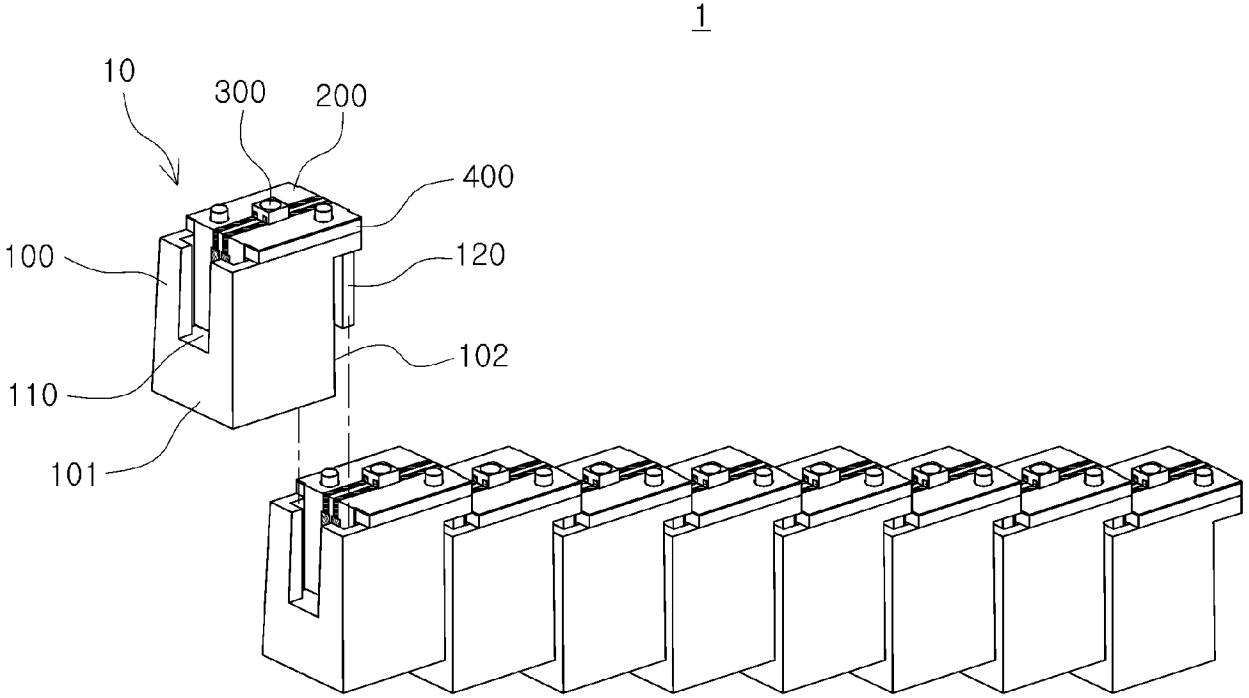
FIG. 1 is a perspective view schematically illustrating a light source assembly according to an embodiment of the present inventive concept.

Hereinafter, embodiments of the present inventive concept will be described in detail with reference to the accompanying drawings. The inventive concept may, however, be embodied in many different forms and should not be construed as being limited to the embodiments set forth herein. Rather, these embodiments are provided so that this disclosure will be thorough and complete, and will fully convey the scope of the inventive concepts to those skilled in the art. In the drawings, the shapes and dimensions of elements may be exaggerated for clarity, and the same reference numerals will be used throughout to designate the same or like elements.

Figure 2:
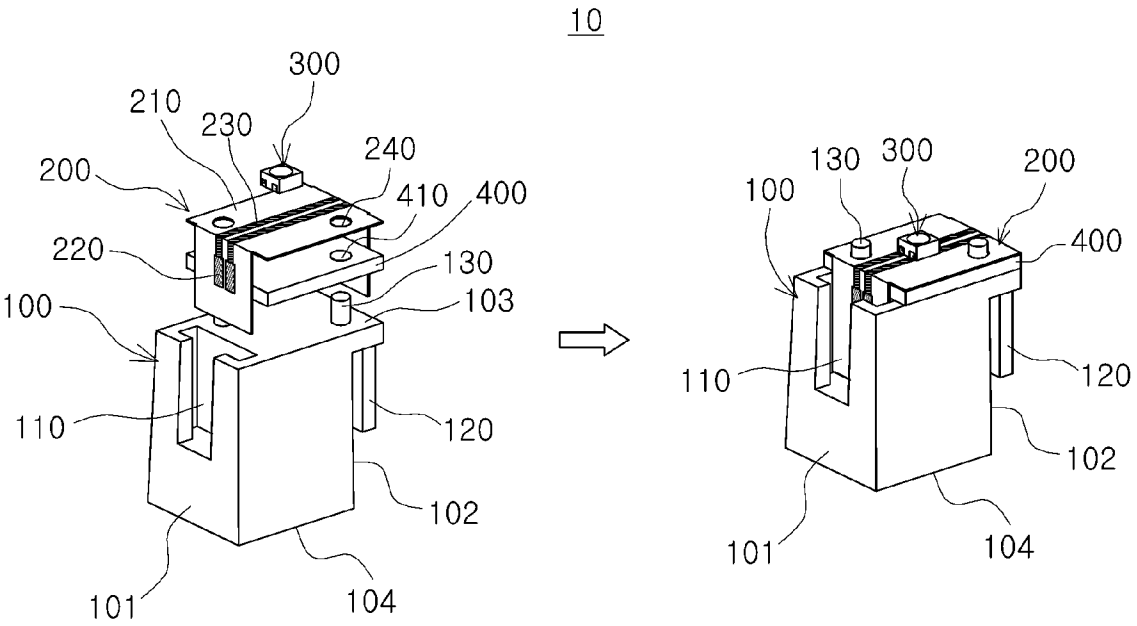
FIG. 2 is a perspective view schematically illustrating parts of a light source module as shown in FIG. 1.
Figure 3:
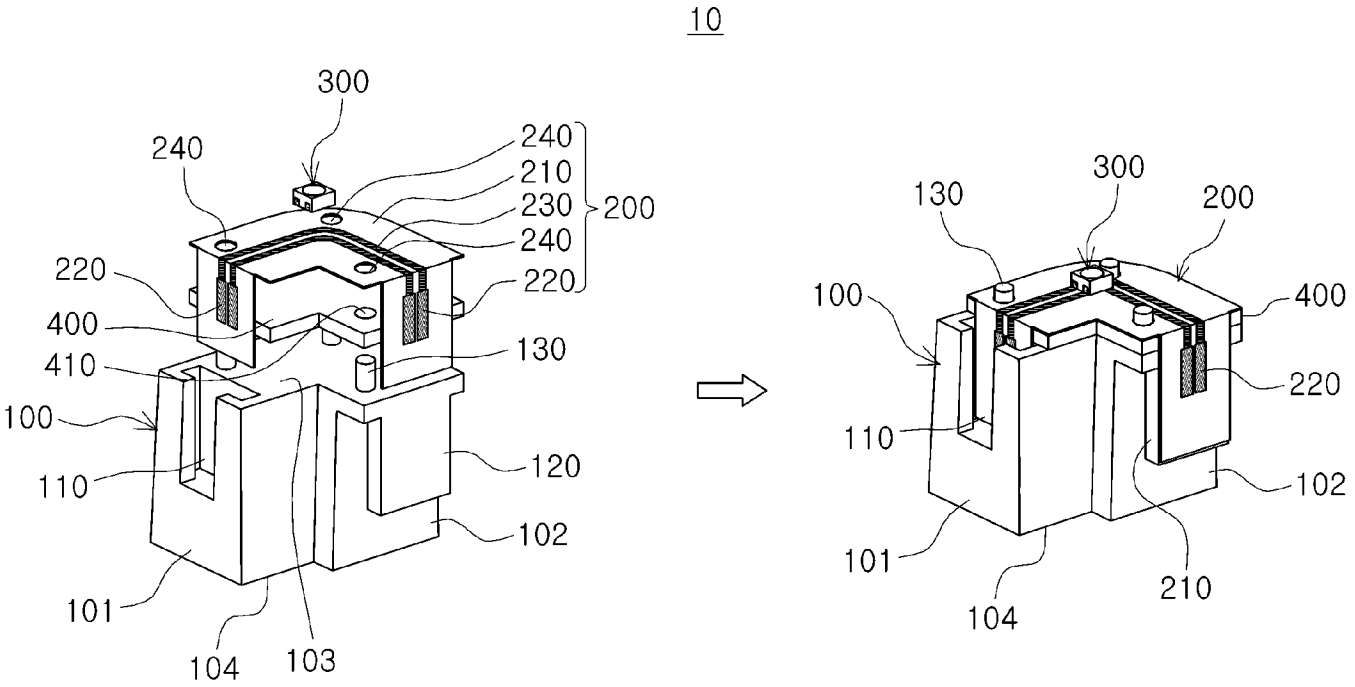
FIG. 3 is a perspective view schematically illustrating a modified example of the light source module of FIG. 2.
Figure 4:
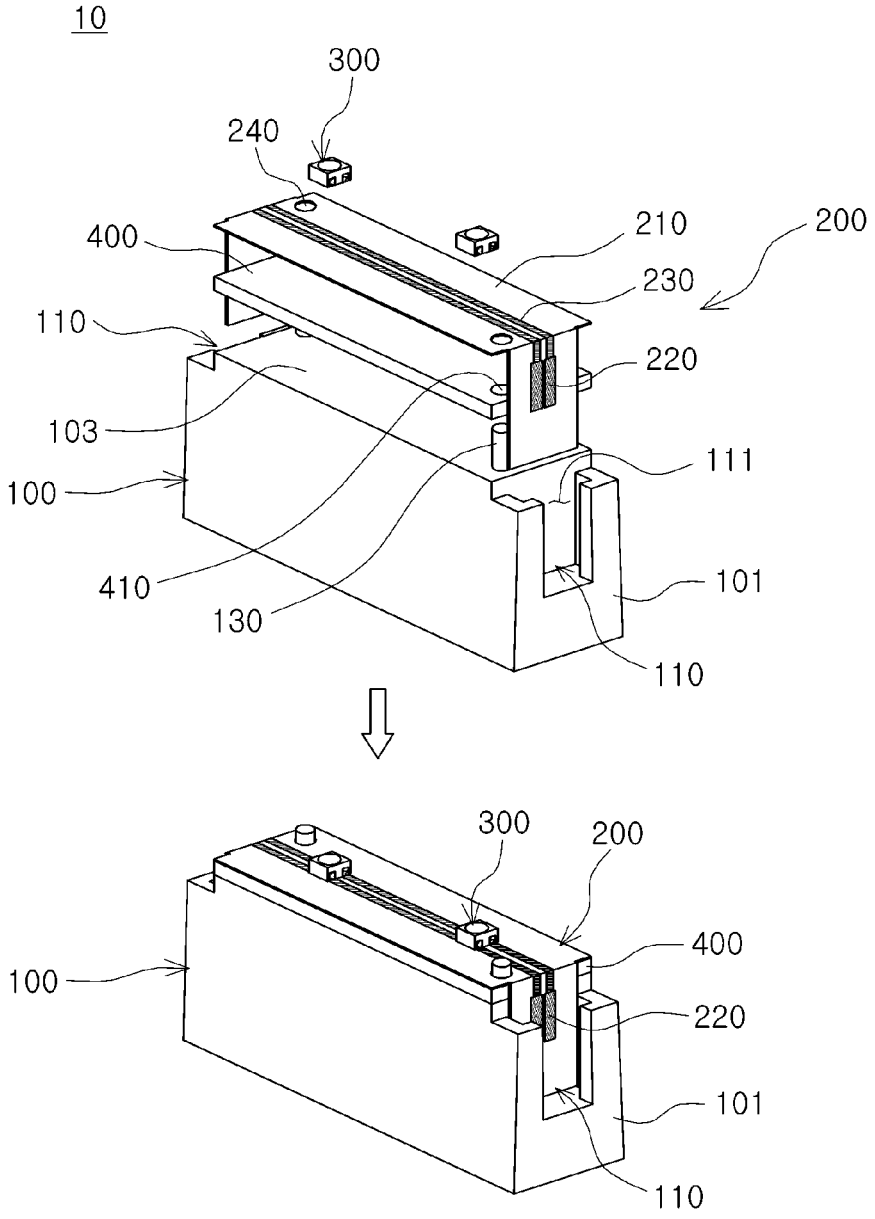
FIG. 4 is a perspective view schematically illustrating another modified example of the light source module of FIG. 2.
Figure 5A:
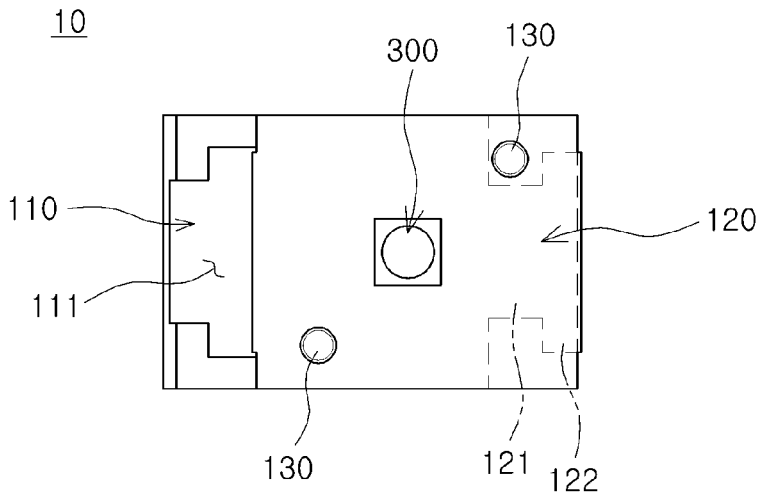
FIGS. 5A and 5B respectively are a top planar view and a cross-sectional view schematically illustrating the light source module of FIG. 2.
Figure 5B:
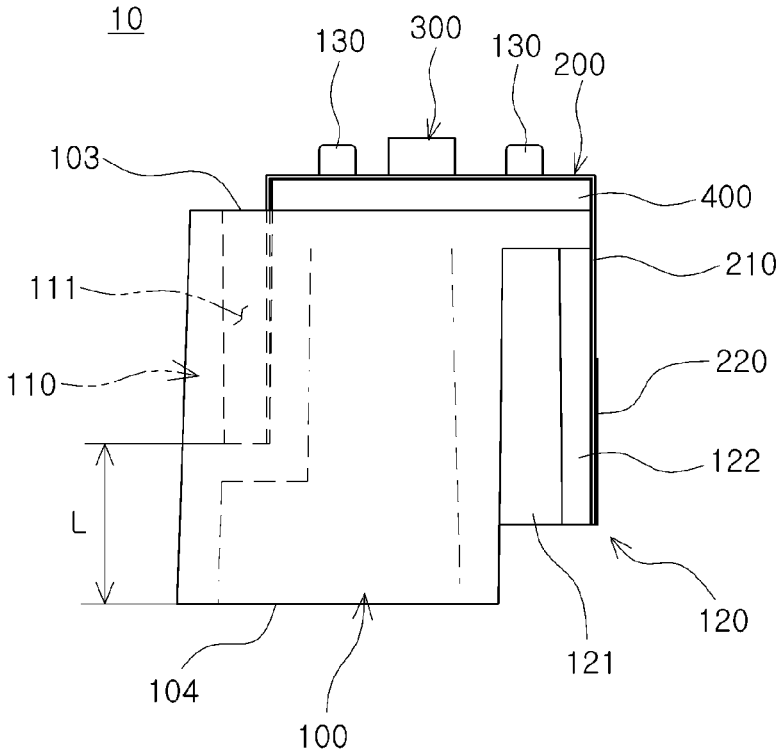
Figure 6:
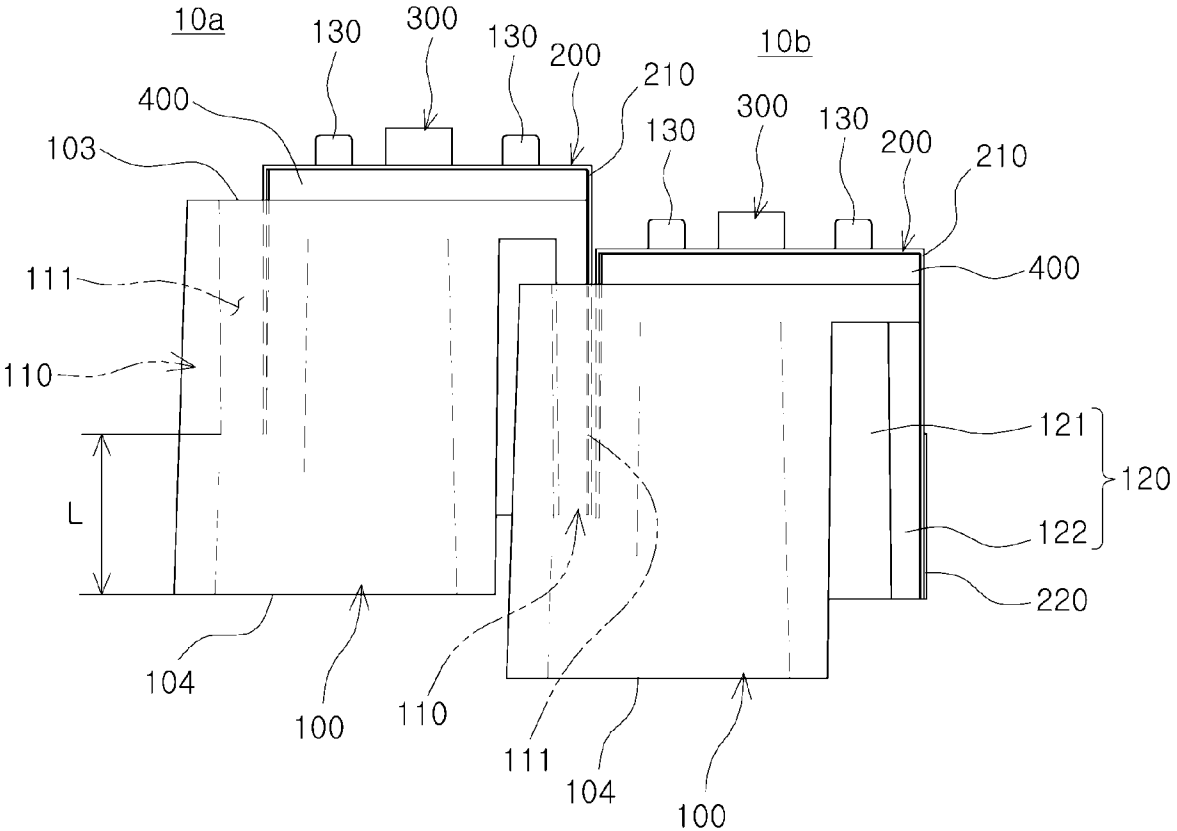
FIG. 6 is a cross-sectional view schematically illustrating a coupling structure of the light source module of FIG. 2.
Figure 7:
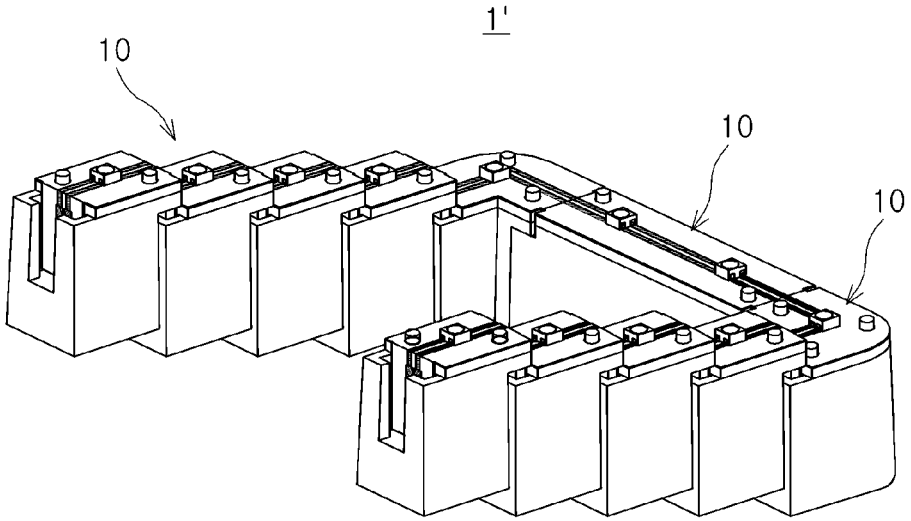
FIG. 7 is a perspective view schematically illustrating a light source assembly according to another embodiment of the present inventive concept.
Figure 8:
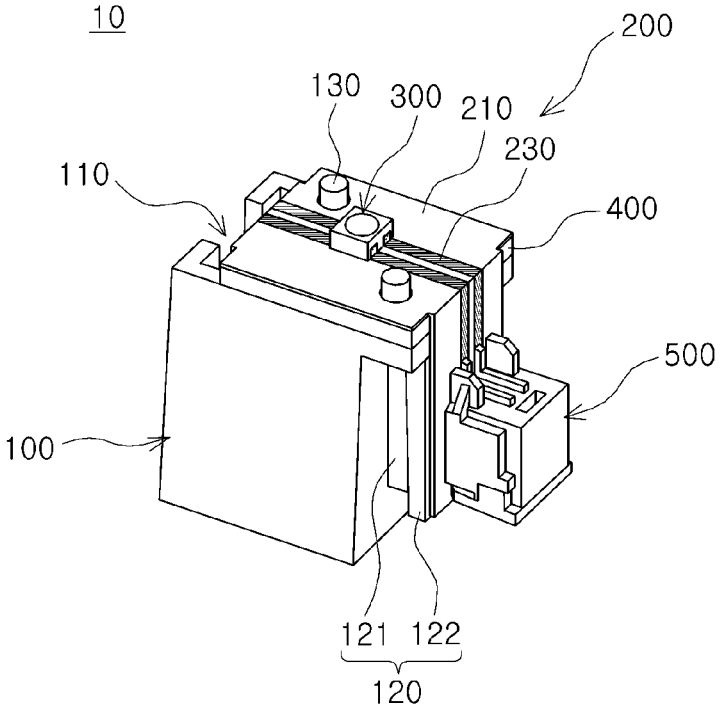
FIG. 8 is a perspective view schematically illustrating a connector provided in the light source module of FIG. 2.

FIG. 1 is a perspective view schematically illustrating a light source assembly according to an embodiment of the present inventive concept. FIG. 2 is a perspective view schematically illustrating parts of a light source module as shown in FIG. 1. FIG. 3 is a perspective view schematically illustrating a modified example of the light source module of FIG. 2. FIG. 4 is a perspective view schematically illustrating another modified example of the light source module of FIG. 2. FIGS. 5A and 5B respectively are a top planar view and a cross-sectional view schematically illustrating the light source module of FIG. 2. FIG. 6 is a cross-sectional view schematically illustrating a coupling structure of the light source module of FIG. 2. FIG. 7 is a perspective view schematically illustrating a light source assembly according to another embodiment of the present inventive concept. FIG. 8 is a perspective view schematically illustrating a connector provided in the light source module of FIG. 2.

Referring to FIGS. 1 through 8, a light source assembly 1 according to an embodiment of the present inventive concept may be include a plurality of light source modules 10 detachably connected to one another. The number and assembly configuration of light source modules 10 may be varied depending on lamp designs according to vehicle models.

Referring to FIGS. 2 through 6, the light source modules 10 will be described.

Each light source module 10 may include a frame part 100, an electrical connection part 200 disposed on the frame part 100, and a light emitting device 300 disposed on the electrical connection part 200.

The frame part 100 may have an upper surface, a lower surface, and a plurality side surfaces connecting the upper surface and the lower surface to form a polyhedral structure. One example in which the frame part 100 has a rectangular parallelepiped structure is illustrated in the embodiment of the present inventive concept, but the frame part 100 is not limited thereto. For example, the frame part 100 may be variously formed, such as having a heptahedral structure or an octahedral structure.

The frame part 100 may include a female coupling 110 formed in one side surface 101 of the plurality of side surfaces and a male coupling 120 formed to be engaged with the female coupling 110 on the other side surface 102 thereof. In the example in which the one side surface 101 and the other side surface 102 are provided as a pair of parallel side surfaces that are opposite to each other is illustrated in the embodiment of the present inventive concept, but is not limited thereto. For example, as in FIG. 3, the one side surface 101 and the other side surface 102 may be orthogonal side surfaces.

In addition, as in FIG. 4, the frame part 100 may include female coupling units 110 both in the one side surface 101 and the other side surface 102. The frame part 100 may also include only male coupling units 120.

As illustrated in FIGS. 5A and 5B, the male coupling 120 may include a support portion 121 protruding from the other side surface 102 of the frame part 100 and a fastening portion 122 extending outwardly and orthogonally with respect to the support portion 121 on an edge of the support portion 121 and accordingly, the male coupling 120 may protrude to have a "T" shape overall as seen in the top planar view of FIG. 5A. In addition, an upper surface 103 of the frame part 100 may be connected to and extend to the fastening portion 122.

The female coupling 110 may have a groove portion 111 having a shape corresponding to and complementary to that of the support portion 121 and the fastening portion 122, such that the support portion 121 and the fastening portion 122 may be fitted into the groove portion 111 to be fixed thereto. In this case, the groove portion 111 may be open to the upper surface 103 of the frame part 100, and may be in a position spaced away from a lower surface 104 of the frame part 100 by a predetermined distance L.

Thus, as illustrated in FIG. 6, in order to connect two light source modules 10 to one another, when the male coupling 120 of one light source module 10*a* is connected to the female coupling 110 of another light source module 10*b* among the plurality of light source modules 10, the male coupling 120 of the light source module 10*a* may be inserted into the female coupling 110 of the light source module 10*b* to a position spaced apart from the lower surface 104 of the frame part 100 by the predetermined distance L. The upper surface 103 of the light source module 10*a* and the upper surface 103 of the light source module 10*b* may thus not be disposed on the same level, and may instead be disposed on different levels. Thus, the plurality of light source modules 10 connected to one another may have a multi-step structure in which they are each disposed on different levels.

Meanwhile, the frame part 100 may have at least one projection 130 projecting from the upper surface 103 thereof. The projection 130 may be selectively provided. In the example shown in FIG. 2, a plurality of the projections 130 are provided on the upper surface 103 of the frame part 100. However, the present inventive concept is not limited thereto. For example, the projections 130 may be omitted.

The projections 130 may serve as a fiducial mark guiding a mounting position of the electrical connection part 200 and a description thereof will be provided later.

The frame part 100 may be formed of a metallic material having a high degree of heat conductivity in order to improve heat radiation efficiency. The frame part 100 may be mass-produced using a progressive-die-casting, a semi-progressive-die-casting, and/or a die-casting shaped mold.

In addition, the frame part 100 may be mass-produced using a resin material having a high degree of heat conductivity through an injection molding method or the like. In situations in which the frame part 100 is formed of a resin material, the frame part 100 may further include a heat radiation plate 400 formed on the upper surface 103 thereof and interposed between the frame part 100 and the electrical connection part 200. The heat radiation plate 400 may be formed of a metallic material having excellent heat conductivity. An example in which the heat radiation plate 400 is provided on the upper surface 103 of the frame part 100 is illustrated in FIG. 2, for example. However, the present inventive concept is not limited thereto. For example, the heat radiation plate 400 may be omitted.

The heat radiation plate 400 may be provided with a through hole 410 into which the projection 130 may be inserted. The through hole 410 may guide a mounting position of the heat radiation plate 400 on the frame part 100 to ensure proper alignment of the heat radiation plate 400 on the frame part 100. The through hole 410 may further allow the heat radiation plate 400 to be stably fixed to the frame part 100 without being separated therefrom.

As described above, a plurality of frame parts 100 that are mass-produced and have a standardized shape may be connected to one another through an assembly process using a simple insertion-fixing method. The assembly process enables formation of a heat sink structure having a step structure for mounting one or more light emitting device(s) 300 thereon.

The frame parts 100 may be commonly used regardless of vehicle model, and may be used to form heat sink structures satisfying design conditions of various vehicle models. In particular, different heat sink structures may be easily manufactured by adjusting the number and configuration of assembled frame parts 100. For example, vehicle daytime running lights (DRLs), rear lamps, or the like, may have various design structures according to vehicle model. The heat sink structure may thus be formed to have steps so as to be consistent with a curved portion of a vehicle, such as the vehicle's edge portion. That is, regions on which respective light emitting devices are mounted may be formed in a stepped manner.

According to an embodiment of the present inventive concept, large or small numbers of frame parts 100 can be connectively assembled in order to produce light source assemblies and heat sink structures complying with different vehicles' lamp designs. Each light source assembly including a heat sink structure can be easily manufactured. As shown in FIG. 1, the frame parts 100 may be connected in a linear manner. The frame parts 100 may also be connected to one another in other configurations, as shown in FIG. 7, such that the degree of freedom of design may be increased.

In addition, since it is not necessary to separately manufacture a single structural heat sink having a plurality of steps for each vehicle model, separately manufacturing molds according to respective models may not be required, such that investment costs and manufacturing costs may be reduced.

The electrical connection part 200 may be disposed on the upper surface 103 of the frame part 100. The electrical connection part 200 can extend to the one side surface 101 having the female coupling 110 formed therein, and to the other side surface 102 having the male coupling 120 formed thereon, to thereby be exposed externally. That is, the electrical connection part 200 may be provided to cover at least a portion of the upper surface 103, the one side surface 101, and the other side surface 102 of the frame part 100 and may be exposed externally on the respective surfaces.

Specifically, the electrical connection part 200 may include a substrate 210 covering the upper surface 103, the one side surface 101, and the other side surface 102 of the frame part 100. The electrical connection part 200 may further include electrode pads 220 respectively disposed on or in the female coupling 110 and the male coupling 120 in the one side surface 101 and the other side surface 102. The electrode pads are exposed externally. The electrical connection part 200 may also includes a circuit pattern 230 provided on the substrate 210 and connected to the light emitting device 300 and to each of the electrode pads 220.

The substrate 210 may be formed of a material that is easily bendable and can be formed to correspond to a shape or structure of the frame part 100, and may include a flexible printed circuit board (FPCB), for example. In addition, the substrate 210 may be formed of a material having excellent heat conductivity in order to improve heat radiation efficiency, and may be a film formed of a flexible metallic material, for example. In one example in which the substrate is conducting, an insulation layer is interposed between the substrate 210 and the electrode pads 220 to prevent the occurrence of electrical short circuits.

The substrate 210 may be bent and extended from the upper surface 103 of the frame part 100 to the one side surface 101 and to the other side surface 102. The portion of substrate 210 that extends to the one side surface 101 may be disposed in the groove portion 111 of the female coupling 110 formed in the one side surface 101. The portion of the substrate 210 that extends to the other side surface 102 may be disposed on a surface of the fastening portion 122 of the male coupling 120 formed on the other side surface 102.

The electrode pads 220 may be formed on the portion of the substrate 210 that extends to the one side surface 101 and on the portion of the substrate 210 that extends to the other side surface 102. The electrode pads 220 may be exposed to the groove portion 111 of the female coupling 110 and exposed to the external surface of the fastening portion 122 of the male coupling 120.

Thus, as illustrated in FIG. 6, the male coupling 120 of one light source module 10*a* is engaged with and connected to the female coupling 110 of another light source module 10*b*, among the plurality of light source modules 10. When the male coupling 120 is engaged with the female coupling 110, the electrode pads 220 exposed in the male coupling 120 are in contact and electrical connection with the electrode pads 200 exposed in the female coupling 110.

The circuit pattern 230 may be connected to the electrode pads 220, and in the case in which a plurality of frame parts 100 are connected to one another through the engagements of the female and male coupling units 110 and 120, the circuit pattern 230 may allow the plurality of frame parts 100 to be electrically connected to each other.

The circuit pattern 230 may be provided such that the plurality of frame parts 100, and the plurality of light emitting devices 300 disposed thereon, are electrically connected to one another in series or in parallel. The circuit pattern 230 may be provided such that the plurality of frame parts 100 are electrically connected to one another in series and parallel.

Meanwhile, the electrical connection part 200 may be provided with arrangement holes 240 used for guiding the mounting position thereof when the electrical connection part 200 is mounted on the frame part 100. The arrangement holes 240 may penetrate through the substrate 210. An example in which two arrangement holes 240 are provided is illustrated in the embodiment of the present inventive concept shown in FIG. 2. However, the present inventive concept is not limited to the use of two arrangement holes 240. For example, more than two arrangement holes 240 may be provided.

The number and positions of the arrangement holes 240 may correspond to those of the projections 130 formed on the upper surface 103 of the frame part 100. Thus, when the electrical connection part 200 is mounted on the frame part 100, the projections 130 may be inserted into the arrangement holes 240 to allow the electrical connection part 200 to be mounted in an appropriate position.

The light emitting device 300 may be mounted on the electrical connection part 200 and disposed on the upper surface 103 of the frame part 100.

The light emitting device 300 may include an LED, and may be a kind of semiconductor device configured to emit light having a predetermined wavelength when external power is applied thereto. The light emitting device 300 may emit blue light, green light, or red light according to a material contained therein, and may also emit white light.

The light emitting device 300 can be provided as a single package including an LED chip therein. More generally, however other types of light emitting devices 300 can be used, such as devices formed of multiple packages. In one example, the light emitting device 300 may be an LED chip itself. In such a case, the LED chip may be a chip on board (COB) LED chip and may be mounted on the electrical connection part 200 to be electrically connected to the circuit pattern 230 in a flip chip bonding scheme or a wire bonding scheme.

In the embodiment shown in FIG. 2, a single light emitting device 300 is provided on each frame part 100; however, the present inventive concept is not limited thereto. For example, a plurality of light emitting devices 300 may be disposed on the electrical connection part 200 on the upper surface of the frame part 100. In this case, the plurality of light emitting devices 300 may be the same type of devices, that generate light having the same wavelength, or different types of devices, that generate light having different wavelengths.

As shown in FIG. 8, a connector 500 may be provided on one of the side surfaces of the frame part 100 and connected to the electrical connection part 200. The connector 500 may be provided on a side surface having the female or male coupling 110 and 120 formed thereon, as shown in FIG. 8. Additionally or alternatively, the connector 500 may be provided on a side surface other than the side surfaces having the female and male coupling units 110 and 120 formed thereon. An example in which the connector 500 is provided on the side surface 102 having the male coupling part 120 formed thereon is shown in FIG. 8; however, the present inventive concept is not limited thereto.

In addition, the connector 500 may be provided instead of the female coupling 110 on the one side surface 101 of the frame part 100, or may be provided instead of the male coupling 120 on the other side surface 102.

The connector 500 may be electrically connected to the electrical connection part 200 and supplied with external power to drive the light emitting device 300.

Figure 9:
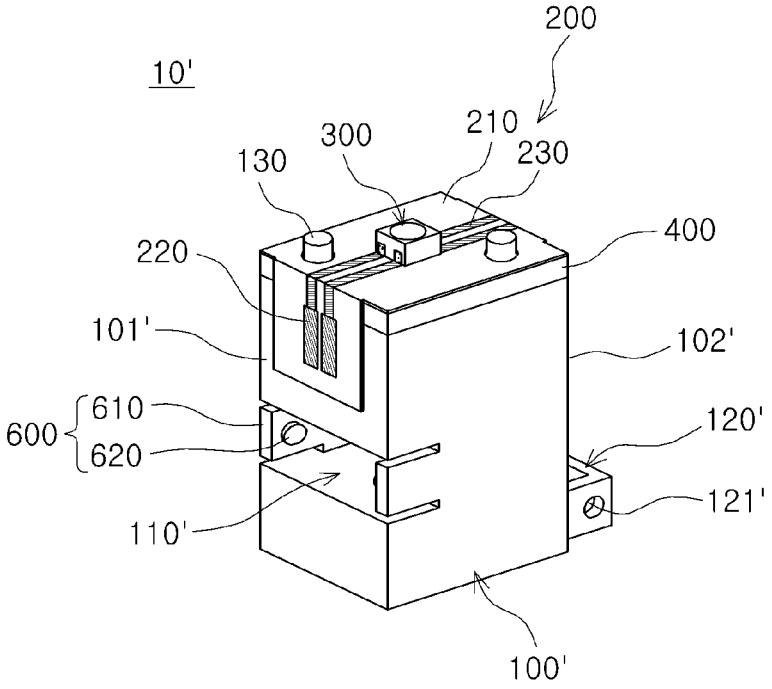
FIG. 9 is a perspective view schematically illustrating a light source module according to another embodiment of the present inventive concept.
Figure 10:
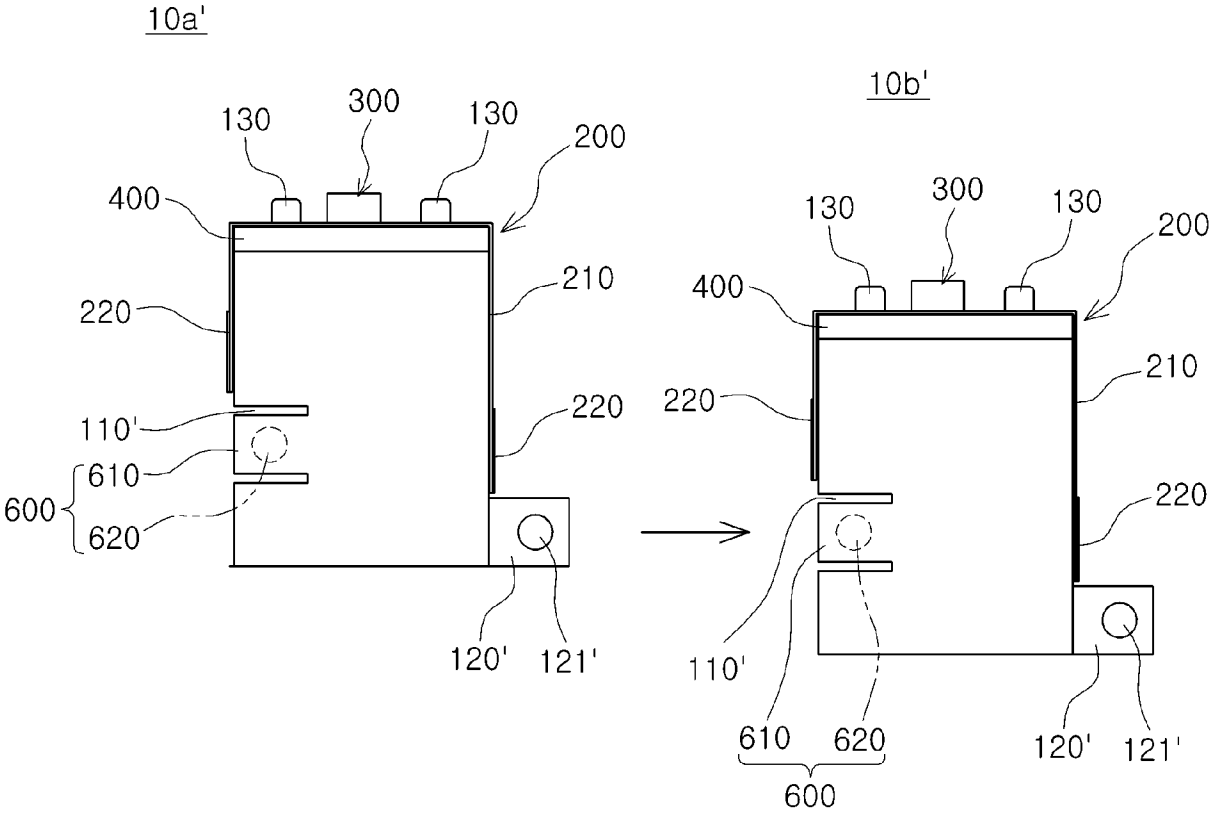
FIG. 10 is a cross-sectional view schematically illustrating a coupling structure of the light source module of FIG. 9.
Figure 11A:
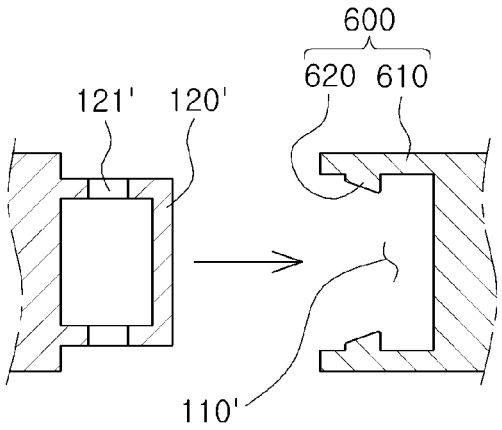
FIGS. 11A, 11B, and 11C are cross-sectional plan views each schematically illustrating a structure of a protruding unit being coupled to a fixing element, in the light source module of FIG. 9.
Figure 11B:
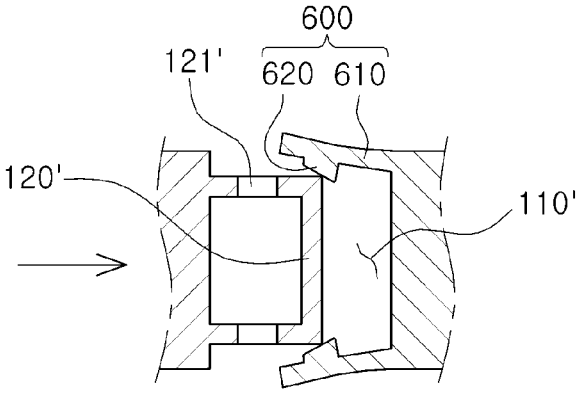
Figure 11C:
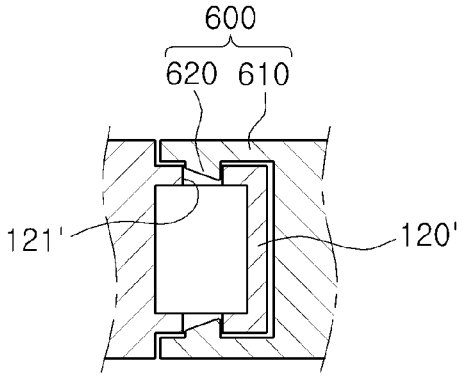

FIGS. 9, 10, and 11A-11C illustrate a light source module according to another embodiment of the present inventive concept. FIG. 9 is a perspective view schematically illustrating a light source module according to another embodiment of the present inventive concept. FIG. 10 is a cross-sectional view schematically illustrating a coupling structure of the light source module of FIG. 9. FIGS. 11A through 11C are cross-sectional plan views each schematically illustrating a structure of a protruding unit being coupled to a fixing element, in the light source module of FIG. 9.

Many of the elements and structures of the light source modules according to another embodiment, as illustrated in FIGS. 9, 10, and 11A-11C, are substantially the same as corresponding elements and structures of the embodiments illustrated in FIGS. 1 through 8. Descriptions of such substantially identical elements and structures will not be repeated here. Instead, the description of FIGS. 9, 10, and 11A-11C will focus on differences between the different embodiments.

As illustrated in FIGS. 9, 10, and 11A-11C, a light source module 10' according to one embodiment may include a frame part 100', the electrical connection part 200, the light emitting device 300, and a fixing element 600.

The frame part 100' may have an upper surface, a lower surface, and a plurality of side surfaces connecting the upper surface and the lower surface to form a polyhedral structure. The frame part 100' may include a receiving groove 110' disposed in one side surface 101' among the plurality of side surfaces. The frame part 100' may further include a protruding unit 120' formed on another surface 102'. In one example, the other surface 102' is aside surface located on aside opposite to the one side surface 101', as shown in FIG. 9. The protruding unit 120' may have a structure corresponding to that of the receiving groove 110' such that the protruding unit 120' of one frame part 100' may be fitted into the receiving groove 110' of another frame part 100' when inserted into the receiving groove 110' of the other frame part 100'.

The protruding unit 120' and the receiving groove 110' may be disposed at different distances from an upper surface 103' of the frame part 100'. For example, the protruding unit 120' may be provided on a lower portion of the other side surface 102' of the frame part 100' and the receiving groove 110' may be provided in an upper portion of the one side surface 101' of the frame part 100'. The protruding unit 120' may thus be provided at a first distance measured from the upper surface 103' of the frame part 100' (or, alternatively, measured from a bottom surface of the frame part 100'), while the receiving groove 110' may be provided at a second distance from the upper surface 103' of the frame part 100' (or, alternatively, from the bottom surface) that is different from the first distance.

Thus, because the protruding unit 120' and the receiving groove 110' are at different distances from the upper surface 103', a plurality of light source modules 10' connected to one another through the protruding units 120' and the receiving grooves 110' may form a step structure. Each step in the structure may have a height corresponding to a difference between the distances of the protruding unit 120' and the receiving groove 110' from the upper surface 103'.

The electrical connection part 200 may be disposed on the frame part 100' and may be exposed both to the one side surface 101' having the receiving groove 110' formed therein and to the other side surface 102' having the protruding unit 120' formed thereon. The electrical connection part 100 may thereby be exposed externally, and may be configured to contact the electrical connection part 200 of other frame parts 100' connected to the frame part 100' using the receiving groove 110' and protruding unit 120'.

The electrical connection unit 200 may include the substrate 210 covering the upper surface, the one side surface 101', and the other side surface 102' of the frame part 100'. The electrical connection unit 200 may further include the electrode pads 220 respectively disposed on the one side surface 101' and the other side surface 102' and exposed externally, and the circuit pattern 230 provided on the substrate 210 and connected to the light emitting device 300 and the electrode pads 220.

The substrate 210 may be formed of a material that is easily bendable and able to be formed to a shape that corresponds to the shape of a structure of the frame part 100'. The substrate 210 may include a flexible printed circuit board (FPCB), for example. In addition, the substrate 210 may be formed of a material having excellent heat conductivity in order to improve heat radiation efficiency, and may be a film formed of a flexible metallic material, for example. In one example, an insulation layer is interposed between the substrate 210 and the electrode pads 220 to prevent the occurrence of electrical short circuits between the substrate 210 and electrode pads 220.

The substrate 210 may be bent so as to extend from the upper surface of the frame part 100' to the one side surface 101' having the receiving groove 110' formed therein and to the other side surface 102' having the protruding unit 120' formed thereon.

The electrode pads 220 may be provided on portions of the substrate 210 that respectively extend onto the one side surface 101' and onto the other side surface 102'. The electrode pads 220 may thus be disposed on the one side surface 101' and on the other side surface 102', and exposed externally.

Thus, the protruding unit 120' of one light source module **10*a*' is inserted into and connected to the receiving groove 110' of another light source module 10*b*', as shown in FIG. 10. As such, the electrode pads 220 exposed from the one side surface 101' of the other light source module 10*b*' and the electrode pads 220 exposed from the other side surface 102' of the one light source module 10*a*'** may be in contact with each other and electrically connected to each other.

At least one light emitting device 300 may be mounted on the electrical connection part 200 and disposed on the frame part 100'.

The fixing element 600 shown in FIGS. 10 and 11A-11C may be provided in the receiving groove 110', and may be configured to selectively couple and become fixed to a protruding unit 120' inserted into the receiving groove 110'. By doing so, the protruding unit 120' may be detachably coupled to the receiving groove 110'.

Specifically, the fixing element 600 may include an elastic piece 610 provided on each of a pair of side surfaces of the frame part 100' that are perpendicular with regard to the one side surface 101' thereof. The elastic pieces 610 are provided on side surfaces in the receiving groove 110' and have a projecting portion 620 projecting from a free end of the elastic piece 610 towards the receiving groove 110'.

The protruding unit 120' may be provided with a coupling hole 121' located so as to line up with the fixing element 600 provided in a receiving groove 110' when the protruding unit 120' is inserted into the receiving groove 110'. The coupling hole 121' has the projecting portion 620 inserted therein and fixed thereto when the protruding unit 120' is inserted into the receiving groove 110'. Therefore, as shown in FIGS. 11A, 11B, and 11C, the elastic piece 610 is temporarily deformed as a protruding unit 120' is inserted into the receiving groove 110', and returns to its original position due to elasticity once the protruding unit 120' is fully inserted into the receiving groove 110' and the projecting portion 620 is inserted into the coupling hole 121'.

The projecting portion 620 of the fixing element 600 is inserted into and fixed to the coupling hole 121' of the protruding unit 120', such that the protruding unit 120' inserted into the receiving groove 110' may be firmly coupled thereto. The projecting portion 620 is detachably fixed to the coupling hole 121', and can be separated from the coupling hole 121' such that the protruding unit 120' can be easily detached from the receiving groove 110'.

In this manner, the light source assembly 1 configured by connecting the plurality of light source modules 10 and 10' to one another may be formed to make lighting devices for use as vehicles' DRLs, head lamps, rear lamps, brakes and the like.

Figure 12:
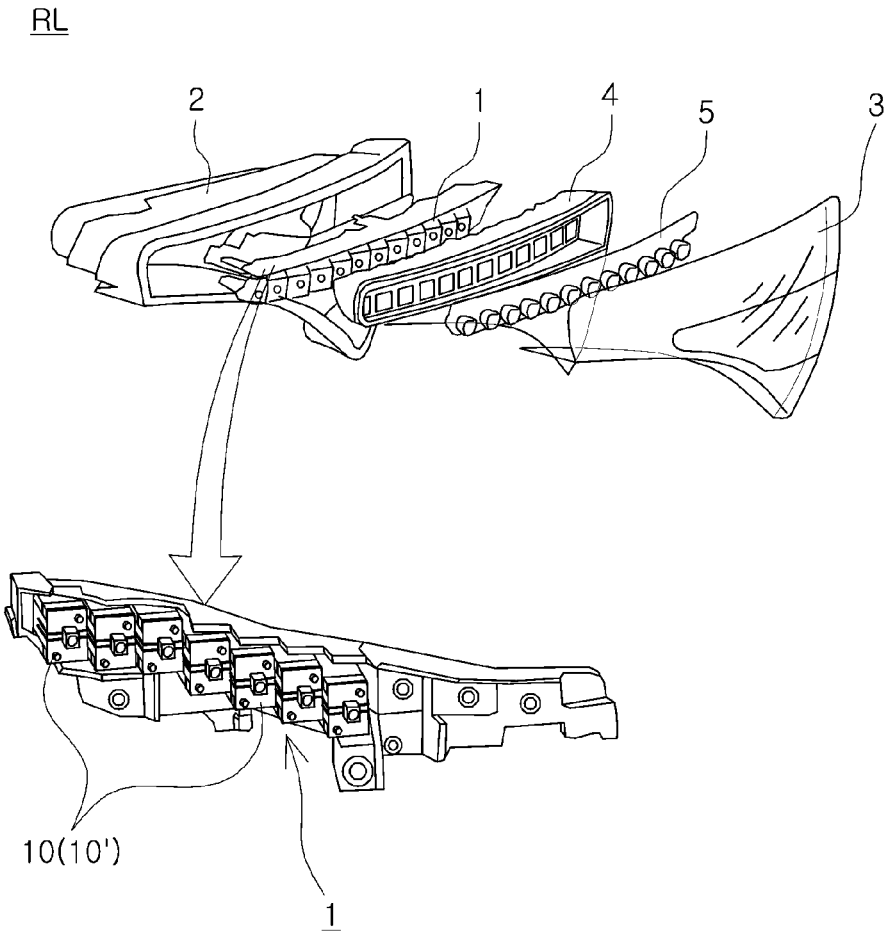
FIG. 12 is a perspective view schematically illustrating a rear lamp of a vehicle in which the light source assembly according to the embodiment is mounted.

FIG. 12 illustrates an example of a vehicle's rear lamp RL as an example of a lighting device formed using the light source assembly described above. The rear lamp RL may include a housing 2 supporting the light source assembly 1, and a cover 3 covering the housing 2 in order to protect the light source assembly 1. In the illustrated example, a reflector 4 and a lens 5 are also included as part of the light source assembly 1.

The rear lamp RL may be entirely smoothly curved so as to correspond to a shape of a corner of a vehicle. Thus, the plurality of light source modules 10 and/or 10' may be assembled such that the stepped structure formed by the assembled light source modules 10/10' has a profile that is consistent with the curved structure of the lamp.

The example of FIG. 12 shows a case in which the light source assembly 1 installed according to a design of the rear lamp RL has a linear structure. However, the structure of the light source assembly 1 may be modified according to the design of the rear lamp RL. Further, the number of the assembled light source modules 10 and 10' included in the light source assembly 1 may be varied. The modifications and variations may be easily performed by adjusting an assembling process of the light source assembly 1 using the plurality of light source modules 10 and 10'.

As set forth above, according to embodiments of the inventive concept, a light source assembly capable of being commonly used regardless of a vehicle model is provided. The light source assembly uses a standardized heat sink structure, and can be easily assembled to form different structures and configurations.

The various advantages and effects according to the present inventive concept are not limited to the descriptions described above.

While the present inventive concept has been shown and described in connection with particular embodiments shown in FIGS. 1-12, it will be apparent to those skilled in the art that modifications and variations can be made without departing from the spirit and scope of the inventive concepts as defined by the appended claims.

What is claimed is:

1. A light source assembly comprising:

a plurality of light source modules detachably connected to one another, each light source module comprising:

a frame part including a female coupling disposed in one side surface thereof and a male coupling disposed on another side surface thereof and configured to be engaged with a female coupling of another light source module of the plurality;

an electrical connection part disposed on an upper surface of the frame part and extending onto the one side surface having the female coupling disposed thereon and onto the other side surface having the male coupling disposed thereon; and at least one light emitting device mounted on the electrical connection part and disposed on the upper surface of the frame part, wherein the plurality of light source modules connected to one another form a step structure in which upper surfaces of each of the plurality of light source modules are disposed on different levels.

2. The light source assembly of claim 1, wherein the male coupling includes a support portion protruding from the other side surface of the frame part and a fastening portion extending outwardly and orthogonally with respect to the support portion on an edge of the support portion, and wherein the female coupling has a groove portion having a shape complementary to a shape of the support portion and the fastening portion.

3. The light source assembly of claim 2, wherein the groove portion is open to the upper surface of the frame part and is disposed in a position spaced away from a lower surface of the frame part by a predetermined distance.

4. The light source assembly of claim 1, wherein the electrical connection part is provided with an arrangement hole, and the frame part includes a projection on the upper surface thereof, the projection configured to be inserted into the arrangement hole.

5. The light source assembly of claim 1, wherein the electrical connection part includes electrode pads disposed on the female coupling and the male coupling , and the female coupling of one light source module is engaged with and connected to the male coupling of another light source module, among the plurality of light source modules, such that the electrode pad disposed on the female coupling of the one light source module and the electrode pad disposed on the male coupling of the other light source module are in contact with and electrically connected to each other.

6. The light source assembly of claim 5, wherein the electrical connection part further includes:

a substrate covering at least portions of the upper surface, the one side surface, and the other side surface of the frame part, and a circuit pattern provided on the substrate and connected to the light emitting device and the electrode pads.

7. The light source assembly of claim 1, further comprising:

a heat radiation plate disposed on the upper surface of the frame part and interposed between the frame part and the electrical connection part.

8. The light source assembly of claim 1, further comprising:

a connector connected to the electrical connection part.

9. A light source assembly comprising:

a plurality of light source modules detachably connected to one another, each light source module comprising:

a frame part including a receiving groove formed in one side surface thereof, and a protruding unit formed on another side surface thereof and configured to be inserted into a receiving groove of another light source module of the plurality;

an electrical connection part disposed on an upper surface of the frame part and extending onto the one side surface having the receiving groove disposed thereon and onto the other side surface having the protruding unit disposed thereon;

at least one light emitting device mounted on the electrical connection part and disposed on the upper surface of the frame part; and a fixing element provided in the receiving groove and configured to selectively be coupled to a protruding unit of another light source module of the plurality that is inserted into the receiving groove.

10. The light source assembly of claim 9, wherein the plurality of light source modules connected to one another form a step structure in which upper surfaces of each of the plurality of light source modules are disposed on different levels.

11. The light source assembly of claim 9, wherein the protruding unit and the receiving groove are disposed at different distances from the upper surface of the frame part, and the plurality of light source modules connected to one another form a step structure in which each step has a height corresponding to a difference between the distances of the protruding unit and the receiving groove from the upper surface of the frame part.

12. The light source assembly of claim 9, wherein the fixing element includes an elastic piece provided on each of a pair of side surfaces of the frame part that are perpendicular with regard to the one side surface, wherein each elastic piece is disposed in the receiving groove and has a projecting portion that projects from the elastic piece into the receiving groove.

13. The light source assembly of claim 12, wherein the protruding unit is provided with a coupling hole configured to have the projecting portion of another light source module inserted therein and fixed thereto when the protruding unit is inserted into the receiving groove of the other light source module.

14. The light source assembly of claim 9, wherein the electrical connection part includes electrode pads disposed on the one side surface having the receiving groove formed therein and on the other side surface having the protruding unit formed thereon, and when the protruding unit of one light source module is inserted into and connected to the receiving groove of another light source module among the plurality of light source modules, the electrode pad disposed on the one side surface of the other light source module and the electrode pad disposed on the other side surface of the one light source module are in contact with and electrically connected to each other.

15. A light source module comprising:

a frame part having an upper surface and a plurality of side surfaces, the frame part including a female coupling disposed in one side surface thereof and a male coupling disposed on another side surface thereof and configured to be engaged with a female coupling of another light source module;

an electrical connection part disposed on the upper surface of the frame part, extending to a first electrode pad disposed on the one side surface having the female coupling disposed thereon, and extending to a second electrode pad disposed on the other side surface having the male coupling disposed thereon; and at least one light emitting device mounted on the electrical connection part and disposed on the upper surface of the frame part, wherein the frame part is configured such that the light source module and the other light source module engaged thereto form a step structure in which upper surfaces of each of the light source modules are disposed on different levels.

16. The light source module of claim 15, wherein the female coupling is disposed in one side surface thereof that is substantially parallel to the other side surface having the male coupling disposed thereon.

17. The light source module of claim 15, wherein the female coupling is disposed in one side surface thereof that is substantially orthogonal to the other side surface having the male coupling disposed thereon.

18. The light source module of claim 15, further comprising a substrate covering at least portions of the upper surface, the one side surface, and the other side surface of the frame part, and having the electrical connection part formed thereon.

19. The light source module of claim 15, further comprising a heat radiation plate disposed on the upper surface of the frame part and interposed between the frame part and the substrate.

* * * * *